US005814825A

United States Patent [19]

Mussman

[11] Patent Number: 5,814,825

[45] Date of Patent: Sep. 29, 1998

[54] RADIATION SHIELDS FOR VALVES

[76] Inventor: Robert L. Mussman, P.O. Box 2805, Bremerton, Wash. 98310

[21] Appl. No.: 787,548

[22] Filed: Jan. 22, 1997

Related U.S. Application Data

[60] Provisional application No. 60/010,304 Jan. 22, 1996.

[51] Int. Cl.[6] ..... G21F 3/02

[52] U.S. Cl. ..... 250/515.1; 250/506.1; 250/519.1

[58] Field of Search ..... 250/515.1, 517.1, 250/519.1, 506.1; 252/628

[56] References Cited

U.S. PATENT DOCUMENTS

| | | | |
|---|---|---|---|
| 926,423 | 6/1909 | Kelly . | |
| 2,756,172 | 7/1956 | Kidd | 250/519.1 |
| 3,340,047 | 9/1967 | Persson et al. | 75/126 |
| 3,858,050 | 12/1974 | Carlson | 250/515 |
| 3,930,943 | 1/1976 | Michel et al. | 176/87 |
| 4,045,416 | 8/1977 | Robson et al. | 260/77.5 |
| 4,070,341 | 1/1978 | Schulze | 260/45.75 |
| 4,106,907 | 8/1978 | Charlton et al. | 23/230.3 |
| 4,223,229 | 9/1980 | Perscio et al. | 250/515 |
| 4,343,841 | 8/1982 | Close | 427/386 |
| 4,422,964 | 12/1983 | Lapolupo | 250/507.1 |
| 4,446,176 | 5/1984 | Close | 427/386 |
| 4,447,478 | 5/1984 | Close | 427/407.1 |
| 4,478,252 | 10/1984 | McLoughlin | 138/149 |
| 4,807,669 | 2/1989 | Prestidge, Sr. | 138/178 |
| 4,830,060 | 5/1989 | Botsolas | 138/149 |
| 4,882,392 | 11/1989 | Smid et al. | 525/328.6 |
| 5,006,185 | 4/1991 | Anthony et al. | 156/193 |
| 5,012,114 | 4/1991 | Sisson, Jr. | 250/519.1 |
| 5,139,857 | 8/1992 | Herndon et al. | 428/220 |
| 5,494,740 | 2/1996 | Yoshiro | 250/515.1 |

*Primary Examiner*—Kiet T. Nguyen
*Attorney, Agent, or Firm*—R. Reams Goodloe, Jr.

[57] ABSTRACT

A radiation shield for valves comprises separable portions of shielding composition, such as lead or bismuth, which are provided in hollow cylindrical half-round portions. The shield portions are interfitingly juxtaposed, and preferably interlocked, when installed in their operating, shielding position. The shields may be removably affixed to an existing valve or pipe. The shield has a hard shell coating, preferably of ethylene methacrylic acid copolymer, to prevent the shielding composition, e.g. lead, from contaminating the structure on which it is used. At least one locking or fastening latch mechanism is provided for securing the separable portions one to the other. Most preferably, a hinge mechanism is provided at one side of each of the of separable portions (separable half-rounds, in the ideal case), and the hinge mechanism also preferably serves to secure the pair of separable portions to each other, thus allowing rapid installation. The separable shield portions can then be fastened or locked together on side of the half-rounds opposite the hinge, so that the half-rounds cooperate to form a finished shield with full coverage around the pipe or valve being shielded.

16 Claims, 4 Drawing Sheets

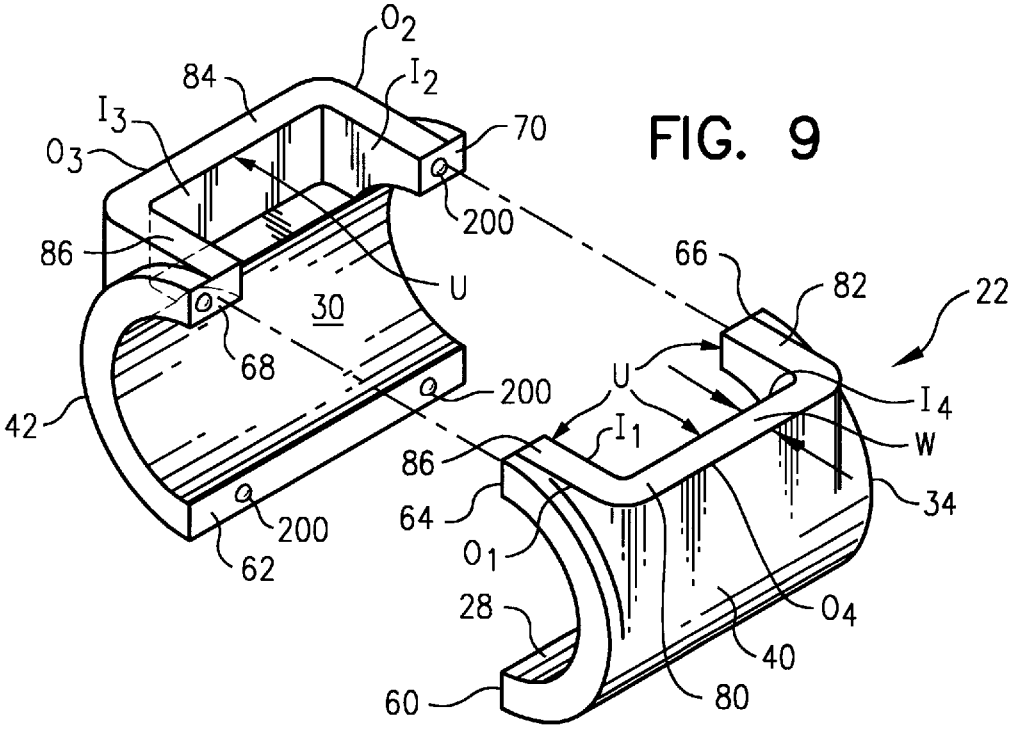
FIG. 9
FIG. 10
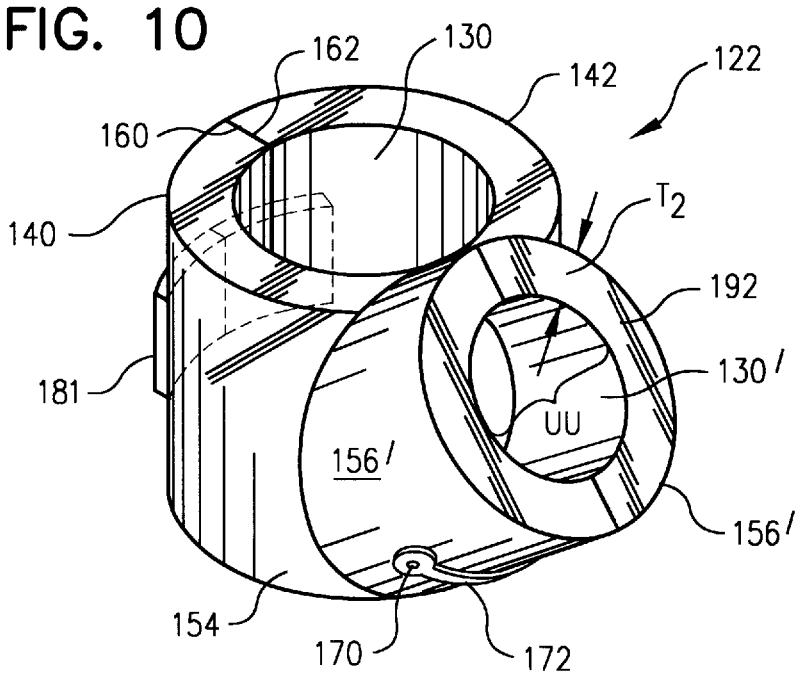

RADIATION SHIELDS FOR VALVES

A portion of the disclosure of this patent document contains material which is subject to copyright protection. The owner has no objection to the facsimile reproduction by anyone of the patent document or the patent disclosure, as it appears in the Patent and Trademark Office patent file or records, but otherwise reserves all copyright rights whatsoever.

This application claims priority from U.S. provisional application Ser. No. 60/010,304, filed Jan. 22, 1996, the disclosure of which is incorporated herein by this reference.

TECHNICAL FIELD OF THE INVENTION

This invention relates to novel, improved devices for radiation shielding, and to methods for fabricating and using the same. Devices of that character are well suited for use in protecting personnel from ionizing radiation in nuclear power plants, and in particular are well suited for reducing the dosage of ionizing radiation received by personnel when working around valves and pipes.

BACKGROUND OF THE INVENTION

During maintenance and overhaul of nuclear power plants, personnel are frequently required to perform operations that bring them into close proximity to locations which have the potential to accumulate, and thus emit, potentially harmful ionizing radiation. A common site at which an accumulation of radioactive substances occurs is at valves which are located in any piping that has or is carrying a radioactive substance. Often, such radioactive contamination occurs in a water or steam circuit line.

In the prior art, various types of shielding have been applied to valves in an attempt to limit the radiation exposures of personnel. Generally, the prior art apparatus and methods known to me are too cumbersome, and they are not particularly well adapted to being secured in place for long term radiation protection. As a result, the overall radiation dosage received by nuclear plant workers could be appreciably reduced with the availability of improved radiation shielding devices, and in particular, with improved devices that are suitable for being left in place to shield against radiation emanating from valves and piping during long term plant operations.

One important problem which must also be overcome with respect to any lead based radiation shield design is the potential for contamination of lead by existing radioactively contaminated materials, as that would result in further contamination since the lead may itself become radioactive. In other words, the use of a lead shield necessitates protection of such a lead shield, to avoid the possibility of further contamination, of either the lead itself, or of the underlying area due to lead becoming deposited thereon. This problem is further aggravated when the shields are placed in locations subject to high temperature or to water spray. Depending upon the anticipated service, a radiation shield may be subject to various adverse or harsh operating conditions, and thus the design must accordingly be capable of reliably protecting the lead during such service.

Currently, when it becomes necessary to work on or near pipe runs which are emitting an appreciable radiation dosage, common practice has been to use a type of wool blanket, or lead shot bags, or lead strips. Each of such apparatus and the methods for their use are somewhat effective in reducing radiation dosage, but in each case, their use has certain drawbacks, including:

(1) the equipment is too bulky (especially in the case of a lead wool blanket);

(2) the equipment is prone to leak (such as in the case of lead shot bags, where loss of lead causes other contamination problems); and (3) installation of the apparatus is too time consuming (such as in the case of installation of lead sheet strips).

The configuration of piping or components in and around valves often limits the amount of the types of such aforementioned radiation shielding which could be placed around a valve. Further, if a valve itself has to be operated, or requires maintenance, placement of such radiation shielding is even further limited, because the placement of shielding can not restrict the operability of the valve, and can not prevent maintenance on the valve.

Radiation shielding devices which provide some of the general capabilities desired have heretofore been proposed. For the most part, prior art devices do not provide permanently affixable radiation shield designs, and thus are inherently not well suited for many of the applications which are of interest to me. Some radiation shielding devices are not suitable for exposure to moderate or high temperatures, or to water spray environments, due to use of a vinyl plastic sheet as a protective surface material. Other portable shields are designed for protection of large areas during major outages, and thus are so large and unique as to be inapplicable for most of the smaller applications of interest to me.

As a result, there still remains an unmet and a continuing need to provide an improved radiation shielding apparatus and method for radiation shielding of valves, and particularly small valves, in a manner that overcomes the deficiencies of the equipment and methods which have been used in the prior art. Specifically, there is an ongoing need for an improved radiation shield for valves which:

(1) allows for rapid and simple installation; and (2) provides effective attenuation of ionizing radiation;

(3) has the assurance that retrieval is possible without encountering adverse lead contamination; and (4) decreases the shield size, and therefore, (5) increases accessibility to the shielded valve to allow many operation and maintenance operations to be conducted with protective shielding in place.

Consequently, I have developed novel radiation shields, and methods for their installation, which provide radiation shields that are superior to earlier radiation shielding apparatus and techniques which are known to me. The advantages offered by my novel radiation shield designs, which are permanently mountable and which may be provided in sizes which are transportable by a single worker, yet be removable and cleanable, are important and self-evident.

SUMMARY OF THE INVENTION

I have now invented, and disclose herein, a novel, radiation shield for use in attenuating exposures of radiation workers to ionizing radiation. Unlike radiation shields heretofore available, my shields are simple to build, particularly for custom applications, easy to install, relatively inexpensive, easy to use while avoiding undesirable lead contamination, and are otherwise superior to the heretofore used or proposed radiation shield devices for valves of which I am aware.

In one exemplary embodiment my radiation shield is provided in specially designed shields which are adapted to fit over the body of an existing valve, and to accommodate existing piping adjacent to the valve. Each shield consists of two or more separable portions (preferably two "half-round" shapes) which are interfitingly juxtaposed, and preferably interlocked, when installed in their operating, shielding position. Also, the separable portions are preferably uncoupled for installation and for removal. Preferably, at least one locking or fastening latch mechanism is provided for securing the separable portions one to the other. Most preferably, a hinge mechanism is provided at one side of each of the of separable portions (separable half-rounds, in the ideal case), and the hinge mechanism also preferably serves to secure the pair of separable portions to each other, thus allowing rapid installation. The separable shield portions can then be fastened or locked together on side of the half-rounds opposite the hinge, so that the half-rounds cooperate to form a finished shield with full coverage around the pipe or valve being shielded. Where appropriate, shield portions can be secured in place by various means, such as tape, wire ties, or steel bands.

My novel radiation shields are simple, durable, and relatively inexpensive to manufacture. In use, they provide a significant measure of reduction in radiation exposure to workers, by virtue of their ease of use in areas which were heretofore difficult to shield, and thus provide a significant improvement in a radiation shield device for valves.

OBJECTS, ADVANTAGES, AND FEATURES OF THE INVENTION

From the foregoing, it will be apparent to the reader that one important and primary object of the present invention resides in the provision of novel radiation shield devices which can be custom fabricated to fit the particular needs of a given application, in order to minimize installation difficulties while maximizing the effective dosage exposure reductions ultimately achieved.

Other important but more specific objects of the invention reside in the provision of radiation shields for valves which:

- can be used in radioactively contaminated areas with minimal risk of contamination by the lead from the shield;
- can be provided in a simple coating that allows use in moist environments;
- which can be used in direct contact with stainless steel piping, valving, and components;
- are relatively simple, particularly in manufacture and installation, to thereby enable the devices to be easily prefabricated and installed for unique applications; and
- which can be easily decontaminated.

My radiation shields are also advantageously provided with coating materials which have additional important and more specific objectives, in that they:

- can be easily used in areas which may encounter high pressure spray;
- can be used in radioactively contaminated areas with a minimum of risk of contaminating the lead in the shield;
- can be used on or around piping and components requiring that the shielding be protected against moisture, heat, and high temperature water or steam;

Coated radiation shields fabricated as described herein can be custom built, and specially designed and fabricated, and which are:

- compatible with direct stainless steel contact;
- easy to decontaminate;
- able to withstand exposure to water or spray;
- easy to install and to remove.

Other important objects, features, and additional advantages of my invention will become apparent to the reader from the foregoing and from the appended claims and as the ensuing detailed description and discussion proceeds in conjunction with the accompanying drawing.

BRIEF DESCRIPTION OF THE DRAWING

FIG. 9 is a perspective view of complimentary "half-round" portions of my radiation shield for valves.

FIG. 10 illustrates a perspective view of my novel radiation shield for valves, such as may be used for a typical globe stop valve in the ½ inch to 1 inch range.

In the various figures of the drawing, identical features will be indicated with identical reference numerals, and similar features in alternate embodiments or locations may be indicated by use of prime (') superscripts, without further mention thereof, as may be appropriate.

DETAILED DESCRIPTION

Figure 1:
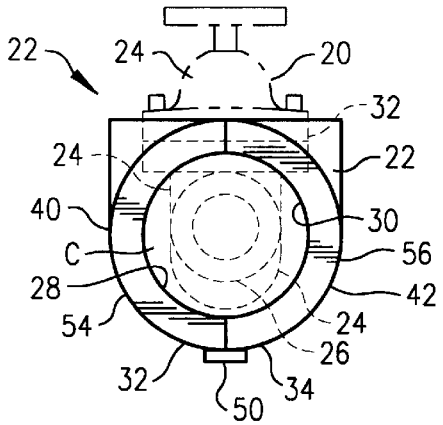
FIG. 1 illustrates an end view of a typical radiation shield for a valve, shown installed about a valve in a pipe run; this view shows the compactness of the shield, and its configuration in a manner which would not interfere with the operation of the valve.
Figure 2:
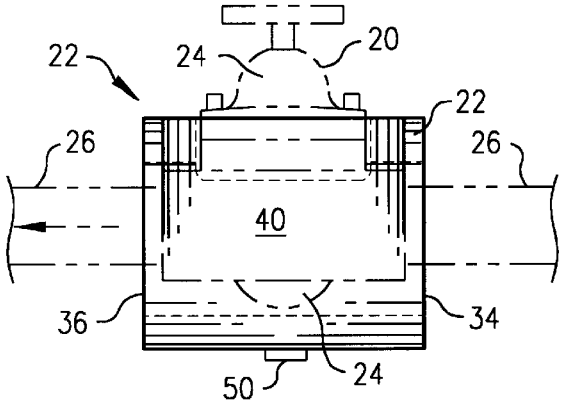
FIG. 2 illustrates a side elevation view of the typical radiation shield for a valve as just set forth in FIG. 1; this side view again shows how my novel radiation shield shield avoids interference with valve operation.
Figure 3:
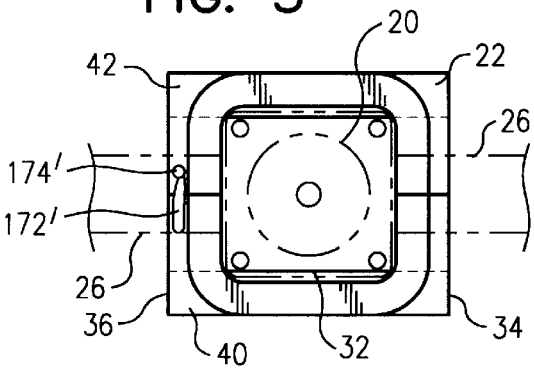
FIG. 3 illustrates a top view of a typical radiation shield for a valve, as just set forth in FIGS. 1 and 2 above, again showing how my novel radiation shield fits around an operating valve.

My invention can be easily understood and appreciated by considering the application for shielding a typical globe valve 20, as is shown in hidden lines in FIGS. 1, 2, and 3. My specially designed radiation shield 22 is shaped to fit over the outer surface or body 24 of globe valve 20, and adjacent piping 26. The fit of the first 28 and second 30 inner surfaces of shield 22 must be in a size large enough to fit around the body 24 of the valve 20, as seen in FIGS. 1 and 2. Ideally, the shield 22 has a relatively close fitting relationship with the pipe 26 and valve 29, especially with the upper reaches 32 of the valve 20, as is illustrated in FIGS. 1 and 3. Also, the shield 22 may be sized so that the inlet 34 and outlet ends 36 (along the longitudinal axis of piping 26) are each sized complementary to the size of the piping 26, so that the first 28 and second 30 inner surfaces of shield 22 fit close to or against pipe 26 in a close fitting, or even abutting, complimentary relationship, as can be appreciated from FIGS. 4 and 5, where a relatively close fit to outer piping surface 26' is illustrated for first 28 and second 30 inner surfaces. Alternately, piping sometimes is accompanied by an insulating layer (not shown), and the configuration shown in FIG. 1 is in such cases appropriate, to allow room for an insulating layer around the pipe 26 below first 28 and second 30 inner surfaces of shield 22.

Each radiation shield 22 comprises complimentary separable portions, preferably "half-rounds" or first 40 and second 42 separable portions. These first and second separable portions 40 and 42 are preferably interfitingly interlocked when installed in their operating, shielding position substantially surrounding valve 20 in an effective radiation attenuation manner. The two or more separable portions, here half-rounds 40 and 42, can be uncoupled for installation on or for removal from partially surrounding valve 20.

The first separable portion 40 and said second separable portion 42 each are manufactured from an effective radiation attenuation solid composition in a thickness suitable for effective attenuation of ionizing radiation. Preferably, the main radiation attenuation solid composition utilized is lead or bismuth, as these can be provided in easily cast parts. The first and second separable portions 40 and 42 are of complimentary size and shape for being releasably joined as a matching pair in a closed, shielding position to form a shell, such as is clear in FIGS. 1 and 3, having a partially closed internal chamber C therebetween formed by internal walls 28 and 30. Ideally, the internal chamber C has internal walls 28 and 30 which are shaped for complementary close fitting engagement with a portion of a valve 20 and a portion of a pipe 26'.

Figure 4:
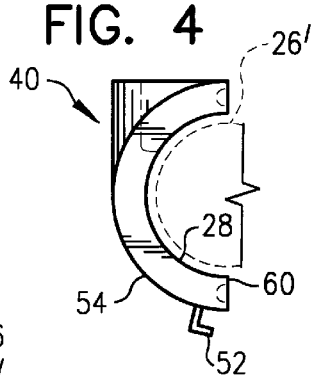
FIG. 4 shows an end view of one half-round of the radiation shield first set forth in FIG. 1 above, showing the approximate size and shape of an exemplary embodiment of my novel radiation shield apparatus.
Figure 5:
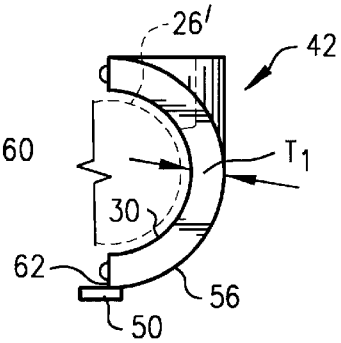
FIG. 5 shows an end view of one half-round of a radiation shield, complimentary to the one-half round just set forth in FIG. 4, showing the shape of an exemplary embodiment of my novel shield.

In one embodiment, as set forth in FIGS. 4 and 5, an interlocking engagement tab 50, and complementary receiving receptacle 52, are provided for interlocking engagement of the first separable portion 40 with the second separable portion 42. An alternate hinge arrangement is noted in FIGS. 16 and 17.

Preferably, my radiation shield is provided with a first separable portion 40 and a second separable portion 42 which are complimentary shaped to form, when engaged in an adjoined relationship, a hollow, substantially cylindrical chamber of radial wall thickness T between inner surfaces 28 or 30 and outer surfaces 54 and 56, respectively.

Figure 7:
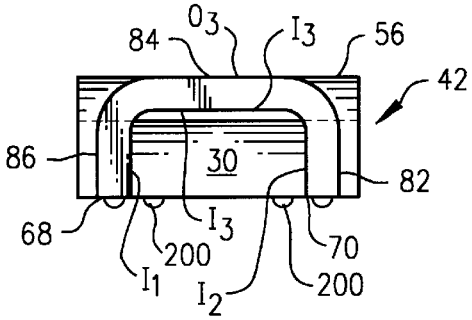
FIG. 7 shows a top plan view of one separable portion, here one half-round of my shield, similar to the one-half round first illustrated in FIG. 4 above.
Figure 6:
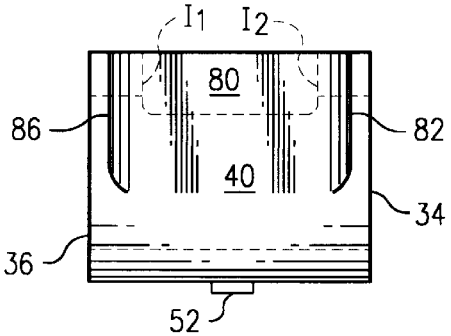
FIG. 6 shows a side elevation view of my radiation shield for a valve, showing the overall shape when used for a typical globe valve.
Figure 8:
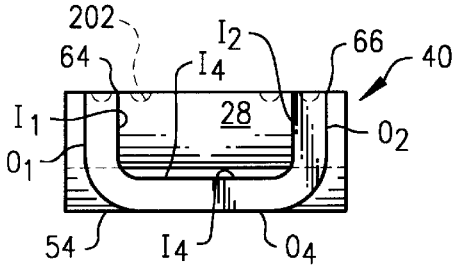
FIG. 8 shows a top plan view of a second separable portion of a radiation shield for valves, complimentary to the one-half round just set forth in FIG. 7, as illustrated in a configuration for use with a typical globe valve.
Figure 11:
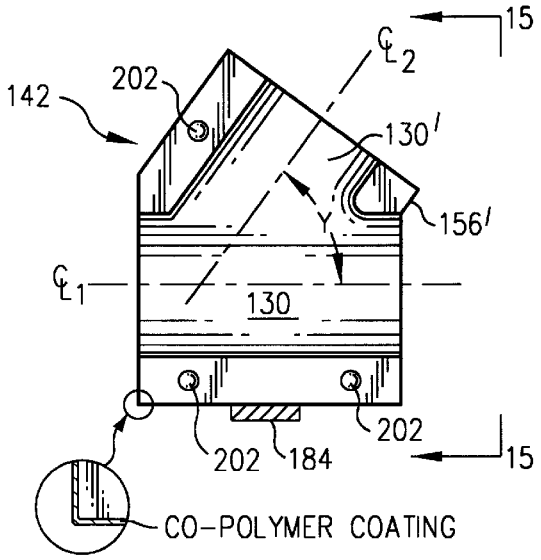
FIG. 11 illustrates a side view of a typical one-half round for use with a globe stop valve. shows, from an end, a cross-sectional view of a first complementary portion of a shield for a typical ½ inch to 1 inch globe stop valve.
Figure 12:
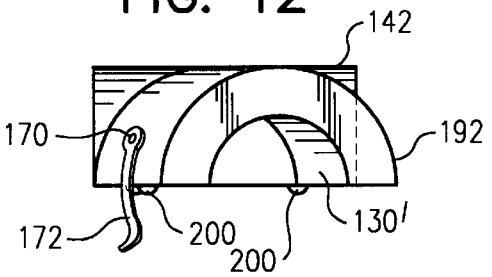
FIG. 12 shows an top view of a first one-half round portion of a radiation shield for a typical globe stop valve, as often seen in the one-half to one inch size range.
Figure 13:
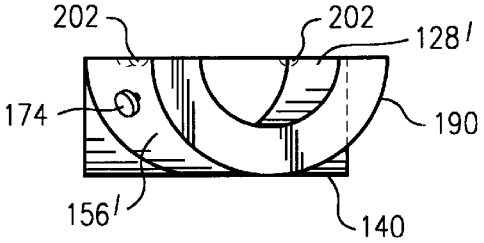
FIG. 13 shows an top view of a second one-half round portion of a radiation shield for a typical globe stop valve, as often seen in the one-half to one inch size range.
Figure 14:
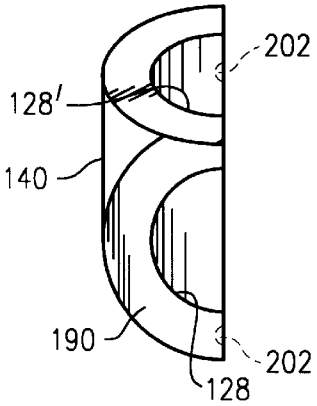
FIG. 14 shows an end view of a first one-half round portion of a radiation shield for a typical globe stop valve, as often seen in the one-half to one inch size range.
Figure 15:
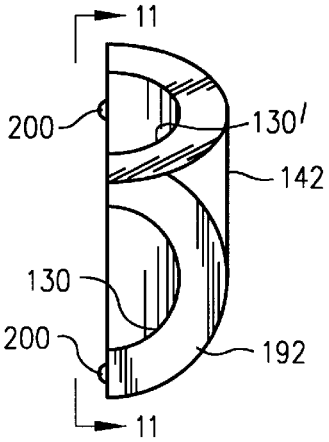
FIG. 15 shows an end view of a second one-half round portion of a radiation shield for a typical globe stop valve, as often seen in the one-half to one inch size range.

Turning now to FIGS. 7, 8, and 9, as noted above, the shield 22 extends lengthwise between an inlet end 34 and an outlet end 36. Extending substantially between the inlet end 34 and the outlet end 36, the first 40 and second 42 separable portions each have a lower abutting wall section, 60 and 62, respectively. Also, the first 40 and second 42 separable portions each have one or more, and preferably a pair, of upper abutting wall portions respectively. On first separable portion 40, abutting wall portions are noted as 64 and 66, and on second separable portion 42, abutting wall portions are noted as 68 and 70, respectively.

An upwardly disposed opening U is located between and inward surface $I_1$ and $I_2$ defined between the opposing pairs of upper abutting wall portions, 64–68 and 66–70, respectively, and inward surfaces $I_3$ and $I_4$ which arise upward from the outer surfaces 54 and 56, respectively. The upwardly disposed opening U is generally sized for upward extension of at least a portion of valve 22 therethrough. The inward surfaces $I_1$, $I_2$, $I_3$, and $I_4$ have companion outer surfaces $O_1$, $O_2$, $O_3$, and $O_4$ that define therebetween an upwardly disposed perimeter wall with portions of thickness W. Each of the perimeter wall portions 80, 82, 84, and 86 extend upwardly from the outer surfaces 54 and 56 of the first and second separable portions 40 and 42 to cooperatively form a perimeter wall substantially surrounding at least a portion of valve 20.

As noted in FIG. 5, and as also evident from FIG. 9, the radiation shield 22 preferably has a thick walled tubular body member of substantially annular partial cross-section of wall thickness $T_1$ extending between an inner surface 30 and an outer surface 56, and extending along a lengthwise axis between an inlet end 34 and an outlet end 36.

Turning now to a second embodiment of my radiation shield, as seen in FIGS. 10–17, a shield 122 can also advantageously be provided with angular disposed tubular portions, rather than with an open top with perimeter wall as illustrated in FIGS. 1–9 above. In such a case, first 140 and second 142 separable portions, have first and second axes, respectively, which meet at an angle Y. Along each axis is are disposed a central hollow cylindrical portion having an interior wall, 128 and 130 along the first or primary axis $C_{L1}$, and 128' and 130' along the secondary axis $C_{L2}$ respectively. The cylindrical portion along the secondary axis is angularly and upwardly disposed toward an opening UU, which is defined by the inside walls 128' and 130' from the cylindrical portions 190 and 192. The angularly and upwardly disposed opening UU extending angularly and upwardly from the inner surface 128 and 130 of each of the first 140 and second 140 separable portions to cooperative form therebetween a thick walled tubular body member of substantially annular partial cross-section of wall thickness $T_2$ extending between an inner surface 130' and an outer surface 156'. This thick tubular wall provides an angularly and upwardly disposed opening generally sized surrounding and providing for upward extension of at least a portion of a valve therethrough, in a manner that radiation emanating therefrom can be attenuated.

Also illustrated in FIGS. 10, 12, 16 and 17 is a hinge mechanism and latch which I prefer to use in order to easily install my valve shields 22 or 122. As noted in FIG. 10, a latch support, such as pin 170, is affixed to one of the separable portions. A manually engageable latch 172 is moveably secured by the latch support 170. As noted from FIG. 13, a catch 174 is affixed to either the first 140 or second 142 separable portion, in the complementary separable portion. The catch 174 is adapted to lockingly engage the manually engageable latch 172, so as to secure the first 140 and second 142 separable portions one to the other.

Figure 16:
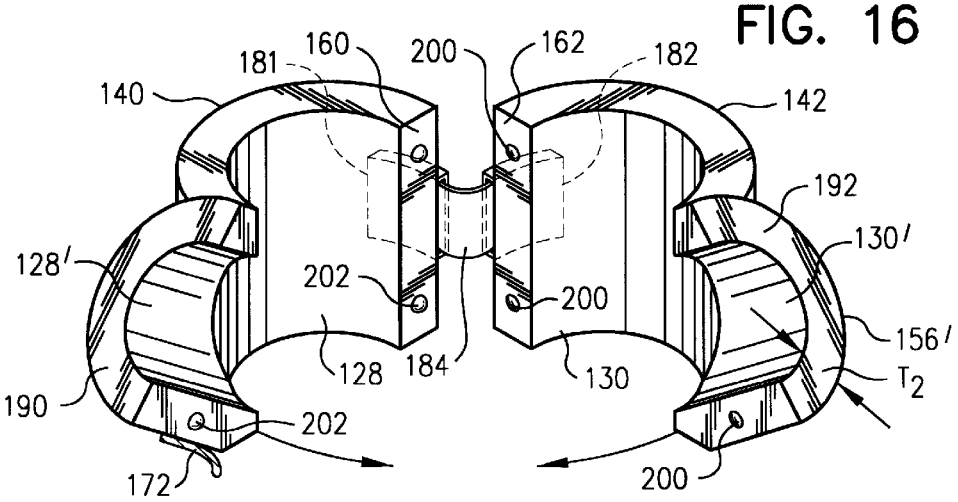
FIG. 16 illustrates two complimentary radiation shield portions in an open position, ready for installation around an existing valve.
Figure 17:
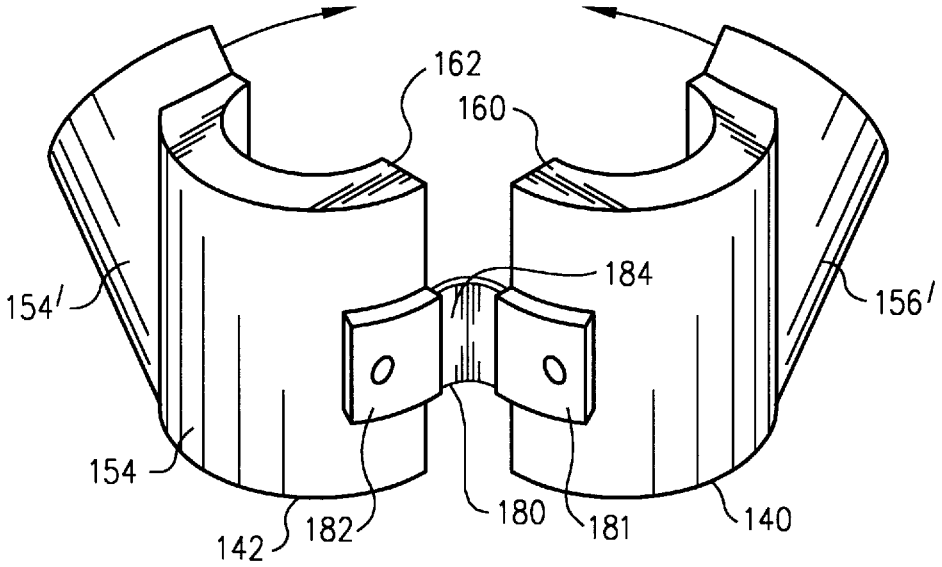
FIG. 17 illustrates the reverse side of two complimentary shield portions in an open position, similar to the shield first set forth in an open position in FIG. 16 above.

Ideally, rather than the interlocking tab arrangement shown in FIGS. 4 and 5, I prefer to use an flexible hinge arrangement as noted in FIGS. 16 and 17. The hinge 180 has a first side 181 affixed to a first separable portion 140, and a second side 182 affixed to a second separable portion 142. The hinge may be any suitable flexible material such as a plastic strip 184, so that the first separable portion and the second separable portion are held together in a manner whereby the radiation shield 122 may be releasably moved between (i) a closed, working position, as seen in FIG. 10, and (ii) an open, installation position, as depicted in FIGS. 16 and 17. The interlocking of first portion 140 and second portion 142 is assisted by use of interfitting locating knobs 200 and detents 202, as seen throughout the FIGS. 9, 11, 16, and 17, for example. By use of the interfitting knobs 200 and detents 202, and the locking mechanism just illustrated, or a comparable arrangement, the separable shield portions can then be fastened together to secure the shield in place. Where appropriate, shield portions can be further secured in place by various means, such as, tape, nylon wire ties, or steel bands.

The configurations for shield 122 provided in FIGS. 10–17 are typical for shielding a ½ inch to 1 inch globe stop valve, which is commonly encountered in nuclear power plants.

Obviously, my radiation shields must be manufactured using an effective ionizing radiation attenuation substance for the body of the shields. I prefer lead, however, bismuth is also available and effective. These materials are preferred because they make for cost effective manufacture via casting methods. The radiation shield thickness is preferably provided in a wall thickness ($T_1$ or $T_2$) off at least about ½ inches in thickness in the radial direction, and is more preferably provided with a wall thickness of at least about ¾ inches in thickness in the radial direction.

To avoid spread of lead contamination, my shields 22 or 122 are preferably coated with a special coating that is durable, easily decontaminated and acts as an effective protective barrier between the shield material and the valve, piping, or, other components. Specifically the most preferred coating comprises a thermoplastic, flexible, polyethylene co-polymer based powder coating which is applied by electrostatic deposition using a flame spray or fluidized bed process. Use of a Dupont "Flamecoat" process and polyethylene copolymer composition is one ideal way to accomplish the preferred coating, however, other flexible plastic coatings of suitable hardness and reliability will undoubtly be entirely serviceable. The coating powder is preferably of the following approximate effective composition:

Solids: 100%

VOC: 0

Specific Gravity: 0.934

Melting Point: 221° F.

Type: Ethylene methacrylic acid copolymer

The final installed coating preferably has the following physical characteristics and properties:

Impact Direct: 384 in.lbs.(on steel) ASTM D-2794

Impact Reverse: 384 in.lbs.(on steel) ASTM D-2794

Adhesion (steel): >1000 PSI ASTM D-454

Water Vapor Transmission: 0.003123 Perm inches at 15 mils thickness

My shields can be manufactured in various sizes and configurations so as to fit any desired valve, including the most common valves found in a nuclear power plant. Most of my shields are designed such that they can be used on most valves of similar type and size, regardless of manufacturer.

Radiation shields using my design can be custom manufactured to be installed around pipe, valves, conduit, or other structures from which radiation is being emitted. The exact design of the shielding will be based on the radiation source(s), the dose rate both (i) contact and (ii) general area type, the project shielding requirements (whether job specific or area dose rate reduction driven), the area configuration, including environmental conditions, the duration (temporary or permanent), and various engineering requirements, such as structure loading and seismic requirements.

In any event, it will thus be seen that the objects set forth above, including those made apparent from the proceeding description, are efficiently attained, and, since certain changes may be made in carrying out the construction of a radiation shielding apparatus to generally in the manner described, while still achieving the objectives as set forth herein. Therefore, it is to be understood that the invention may be embodied in other specific forms without departing from the spirit or essential characteristics thereof. For example, while I have set forth exemplary designs for an encapsulated lead radiation shield of half-round design, many other embodiments are also feasible to attain the result of the principles of the apparatus and via use of the methods disclosed herein. Therefore, it will be understood that the foregoing description of representative embodiments of the invention have been presented only for purposes of illustration and for providing an understanding of the invention, and it is not intended to be exhaustive or restrictive, or to limit the invention to the precise forms disclosed. On the contrary, the intention is to cover all modifications, equivalents, and alternatives falling within the spirit and scope of the invention as expressed in the appended claims. As such, the claims are intended to cover the structures and methods described therein, and not only the equivalents or structural equivalents thereof, but also equivalent structures or methods. Thus, the scope of the invention, as indicated by the appended claims, is intended to include variations from the embodiments provided which are nevertheless described by the broad meaning and range properly afforded to the language of the claims, or to the equivalents thereof.

I claim:

1. A radiation shield for installation about at least a portion of a valve in a pipe line for shielding against ionizing radiation emitted from a radioactive substance within the valve, said radiation shield effectively reduces radiation dosage resulting from said ionizing radiation emitted from within said valve, said radiation shield comprising:

(a) a first separable portion;

(b) a second separable portion;

(c) said first separable portion and said second separable portion each comprising an effective radiation attenuation substance in a thickness for effective attenuation of said ionizing radiation, said first and said second separable portions each of complimentary size and shape for being releasably joined as a matching pair in a closed, shielding position to form a shell having a partially closed internal chamber therebetween, said internal chamber having an internal wall, said internal wall shaped for complementary close fitting engagement with said portion of said valve and a portion of said pipe; and (d) so that said effective radiation attenuation substance attenuates said ionizing radiation emanating from within said valve at least partially enclosed by said radiation shield.

2. A radiation shield for installation about at least a portion of a valve in a pipe line for shielding against ionizing radiation emitted from a radioactive substance within the valve, said radiation shield effectively reduces radiation dosage resulting from ionizing radiation emitted from within said valve, said radiation shield comprising:

(a) at least two separable portions, said at least two separable portions each comprising an effective radiation attenuation substance in a thickness for effective attenuation of said ionizing radiation, said at least two separable portions each of complimentary size and shape for being releasably joined in a closed, shielding position to form a shell having a partially closed internal chamber between said at least two separable portions, said internal chamber having an internal wall, said internal wall shaped for complementary close fitting engagement with said portion of said valve and a portion of said pipe;

(b) so that said radiation shield at least partially encloses said valve, to allow said effective radiation attenuation substance to attenuate said ionizing radiation emanating from within the valve.

3. A radiation shield for installation about at least a portion of a valve in a pipe line for shielding against ionizing radiation emitted from a radioactive substance within the valve, said radiation shield effectively reduces radiation dosage resulting from said ionizing radiation emitted from within said valve, said radiation shield comprising:

(a) a first half-round separable portion, and (b) a second half-round separable portion, (c) said first half-round separable portion and said second half-round separable portion each comprising an effective radiation attenuation substance in a thickness for effective attenuation of said ionizing radiation, said first and said second half-round portions of complimentary size and shape for being releasably joined as a matching pair in a closed, shielding position to form a shell having a partially closed internal chamber therebetween, said internal chamber having an internal wall, said internal wall shaped for complementary close fitting engagement with said portion of said valve and a portion of said pipe; and (d) so that said radiation attenuation substance substantially attenuates passage of said ionizing radiation outward from the valve.

4. The shield as set forth in claim 3, wherein said shield further comprises an interlocking engagement tab for interlocking engagement of said first half-round portion with said second half-round portion.

5. A radiation shield for installation about a valve in a pipe line for shielding against ionizing radiation emitted from a radioactive substance within said valve, said radiation shield effectively reduces radiation dosage resulting from said ionizing radiation emitted at the location of the valve, said radiation shield comprising:

(a) a first separable portion, said first separable portion shaped for complementary close fitting engagement with a first portion of said valve and a first portion of said pipe;

(b) a second separable portion, said second separable portion shaped for complementary close fitting engagement with a second portion of said valve and a second portion of said pipe;

(c) said first separable portion of said shield and said second separable portion of said shield are engaged so as to be releasably joined in a closed, shielding position about said valve and said pipe, wherein said shield effectively reduces the amount of said ionizing radiation passing therethrough.

6. A radiation shield for installation about a valve in a pipe line, said radiation shield attenuates ionizing radiation emitted from a radioactive substance within said valve, said radiation shield effectively reduces radiation dosage resulting from said ionizing radiation emitted at the location of the valve, said radiation shield comprising:

(a) complementary first and second separable portions, each of said first and said second separable portions comprising an effective ionizing radiation attenuation substance, said first and second separable portions shaped to form, when engaged in an adjoined relationship, a hollow, substantially cylindrical chamber of wall thickness T between an inner surface and an outer surface and extending lengthwise between an inlet end and an outlet end;

(b) said first and said second separable portions each further comprising (i) a lower abutting wall section, and (ii) an upper abutting wall portion;

(c) an upwardly disposed opening, said upwardly disposed opening located between said pair of upper abutting wall portions, said upwardly disposed opening generally sized for upward extension of at least a portion of said valve therethrough; and (d) said first and said second separable portions each further comprising an upwardly disposed perimeter wall portions of thickness W, each of said perimeter wall portions extending upwardly from said outer surface of each of said first and second separable portions to cooperatively form a perimeter wall substantially surrounding at least said portion of said valve.

7. A radiation shield for installation about a valve in a pipe line, said radiation shield attenuating ionizing radiation emitted from a radioactive substance within said valve, said radiation shield effectively reducing radiation dosage resulting from said ionizing radiation emitted at the location of the valve, said radiation shield comprising:

(a) complementary first and second separable portions, each of said first and said second separable portions comprising an effective ionizing radiation attenuation substance, said first and second separable portions shaped to form, when engaged in an adjoined relationship, a hollow, substantially cylindrical chamber of wall thickness T between an inner surface and an outer surface and extending lengthwise between an inlet end and an outlet end;

(b) said first and said second separable portions each further comprising (i) a lower abutting wall section, and (ii) an upper abutting wall portion;

(c) an upwardly disposed opening, said upwardly disposed opening located between said pair of upper abutting wall portions, said upwardly disposed opening generally sized for upward extension of at least a portion of said valve therethrough; and (d) said first and said second separable portions each further comprising an upwardly disposed perimeter wall portions of thickness W, each of said perimeter wall portions extending upwardly from said outer surface of each of said first and second separable portions to cooperatively form a perimeter wall substantially surrounding at least said portion of said valve.

8. A radiation shield for installation about a valve in a pipe line, said radiation shield attenuating ionizing radiation emitted from a radioactive substance within said valve, said radiation shield effectively reduces radiation dosage resulting from said ionizing radiation emitted at the location of the valve, said radiation shield comprising:

(a) complementary first and second separable portions, each of said first and said second separable portions comprising an effective ionizing radiation attenuation substance, said first and second separable portions shaped to form, when engaged in an adjoined relationship, a thick walled tubular body member of substantially annular partial cross-section of wall thickness $T_1$ extending between an inner surface and an outer surface, and extending along a lengthwise axis between an inlet end and an outlet end;

(b) said first and said second separable portions each further comprising
(i) a lower abutting wall section, and
(ii) an upper abutting wall portion;

(c) an angularly and upwardly disposed opening, said angularly and upwardly disposed opening extending angularly and upwardly from said outer surface of each of said first and second separable portions to cooperative form a second a thick walled tubular body member of substantially annular partial cross-section of wall thickness $T_2$ extending between an inner surface and an outer surface, hollow cylindrical, said angularly and upwardly disposed opening generally sized to cooperatively form a thick tubular wall substantially surrounding and providing for upward extension of at least a portion of said valve therethrough.

9. The radiation shield as set forth in any one of claims 1, 2, 3, 5, 6, 7, or 8, wherein at least a portion of said effective ionizing radiation attenuation substance is selected from the group consisting of lead and bismuth.

10. The radiation shield as set forth in claim 9, wherein said radiation shield further comprises a hard plastic shell coating.

11. The shield as set forth in claim 10, wherein said coating comprises an ethylene methacrylic acid copolymer.

12. The shield as set forth in claim 11, wherein said coating on said shield has an adhesion on steel of greater than 1000 pounds per square inch.

13. The shield as set forth in claim 11, wherein said coating has a direct impact resistance of at least 384 inch pounds on steel.

14. The shield as set forth in claim 11, wherein said coating has a water vapor transmission not more than 0.003123 perm inches.

15. The radiation shield as set forth in any one of claims 1, 2, 3, 5, 6, 7, or 8 further comprising (a) a latch support, said latch support affixed to either said first or second separable portion;

(b) a manually engageable latch, said engageable latch moveably secured by said latch support;

(c) a catch, said catch affixed to either the first or second separable portion and in the portion opposite in which said latch support is located, said catch lockingly engaging said manually engageable latch, so secure said first and said second separable portions one to the other.

16. The radiation shield as set forth in claim 15, further comprising a hinge, said hinge securing said first separable portion to said second separable portion in a manner whereby said radiation shield may be releasably moved between (a) a closed, working position, and (b) an open, installation position.

* * * * *